US005332227A

United States Patent [19]

Passero

[11] Patent Number: 5,332,227

[45] Date of Patent: Jul. 26, 1994

[54] QUESTION AND ANSWER BOARD GAME

[76] Inventor: Raymond J. Passero, 94 Hill St., Mahopac, N.Y. 10541

[21] Appl. No.: 67,025

[22] Filed: May 26, 1993

[51] Int. Cl.[5] ..... A63F 3/00; A63F 9/18

[52] U.S. Cl. ..... 273/243; 273/141 R; 273/431

[58] Field of Search ..... 273/243, 252, 254, 256, 273/257, 249, 141 R, 431

[56] References Cited

U.S. PATENT DOCUMENTS

| | | | |
|---|---|---|---|
| 4,736,954 | 4/1988 | Haney et al. | 273/236 |
| 4,988,108 | 1/1991 | Shepard | 273/254 |
| 5,092,606 | 3/1992 | Miller | 273/249 |

*Primary Examiner*—Benjamin H. Layno
*Attorney, Agent, or Firm*—E. Michael Combs

[57] ABSTRACT

A question and answer board game is disclosed. The game includes a board having a substantially oval playing track imprinted on it playing surface. The track is divided into fifty one separate sectors. Fifty of those sectors are each labeled with the name of one of the fifty states of the United States, and the remaining sector is labeled "START". A random topic selector having a rotatable spinner is positioned on the center of the board. A topic circle divided into six differently colored sectors which are each labeled with one of six question and answer topics is positioned below the spinner on the center of the board. A uniquely shaped game piece and a set of board markers is provided for each player. The board markers of each set are each colored to match the colors of the topic circle sectors. A die is provided to determine order of play and movement of the game pieces along the track. A deck of question and answer cards is provided with a card for each state. The topic circle may be a separate disc mounted in a recess on the center of the board. The disc is movable vertically relative to the board to cause the spinner to rotate and randomly select one of the topics on the disc.

9 Claims, 5 Drawing Sheets

FIG 8
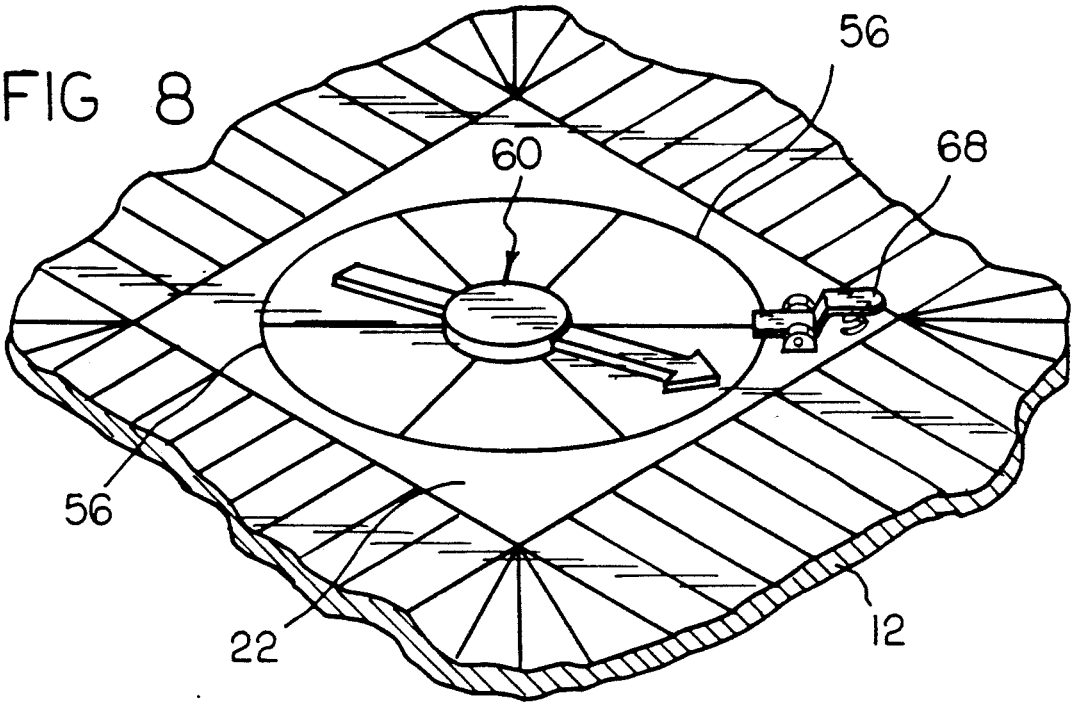
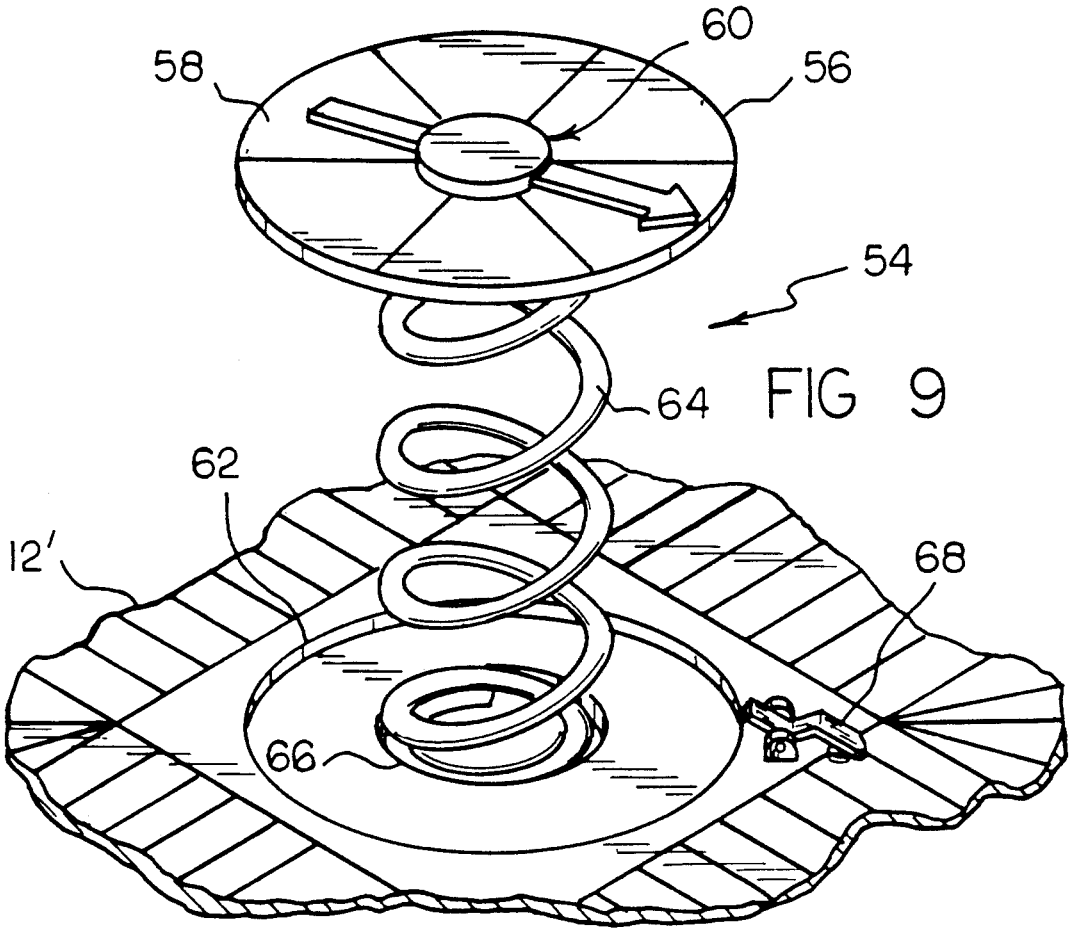
FIG 9

FIG 12

| WYOMING | |
|---|---|
| CAPITOL | WHAT IS THE CAPITAL ? |
| SPORTS | WHAT IS THE NAME OF WYOMINGS PRO FOOTBALL TEAM ? |
| POTPOURRI | WYOMING WOMEN WERE THE FIRST IN THE NATION TO ____? |
| INDUSTRY/ GOODS | WYOMING IS AMONG THE LEADING STATES IN THE PRODUCTION OF ___? |
| NICKNAME | WHAT IS WYOMING'S NICKNAME ? |
| POINT OF INTEREST | WHAT IS THE NAME OF THE NATIONS LARGEST & OLDEST NATIONAL PARK ? |

52

FIG 13

| WYOMING | |
|---|---|
| CAPITOL | CHEYENNE |
| SPORTS | WYOMING DOES NOT HAVE A PRO FOOTBALL TEAM |
| POTPOURRI | VOTE, HOLD PUBLIC OFFICE, SERVE ON JURIES |
| INDUSTRY/ GOODS | PETROLEUM, COAL, NATURAL GAS |
| NICKNAME | EQUALITY STATE |
| POINT OF INTEREST | YELLOWSTONE NATIONAL PARK |

52

QUESTION AND ANSWER BOARD GAME

BACKGROUND OF THE INVENTION

1. Field of the Invention

The field of the invention relates generally to educational board games, and more particularly to an educational and entertaining question and answer board game directed to pertinent biographical data relating specifically to each of the fifty states of the United States of America.

2. Description of the Prior Art

Question and answer board games relating to geography and a wide variety of other subjects are well known. Questions to be answered by the players in these games are primarily randomly determined by manually operable spinners configured as rotatable indicating arrows. Accordingly, question selection is determined solely by the turning force manually applied to the spinner by a player. Further, questions relating to known educational board games directed to the fifty states of the United States are generally restricted to geography.

Various question and answer board games have been utilized in the prior art. For example, U.S. Pat. No. 4,577,485 to Lardon sets forth a question and answer board game having a game track imprinted thereon for receiving markers of the game players for movement therealong in response to correctly answered questions appearing on cards pulled from a plurality of decks randomly selected by throws of a die. Each deck of cards relates to a distinct question category including history, geography, art, literature, theater and cinema, as well as miscellaneous.

U.S. Pat. No. 4,834,389 to Coffman et al discloses another board game having an outline of the continental USA imprinted on it. A principal and several secondary motorcycle routes are marked within the continent to define a path for a simulated motorcycle race across the country. Order of play and movement along the paths is controlled by a spinner on the board and directions given on cards selected from one of a plurality of decks and marked by a token shaped as a motorcycle.

U.S. Pat. No. 4,940,239 to Tuttle illustrates another question and answer board game wherein a playing area defining an endless path is marked on its planar surface. The playing area is subdivided into a plurality of smaller areas which each have an endless playing path and a separate set of question and answer cards therefor. The question and answer cards relate to missing words of quotations or definitions. Order of play and movement in each subdivision is controlled by a die and recorded by colored position markers in response to correct answers to the questions asked on the randomly selected cards.

U.S. Pat. No. 4,984,805 to Medlock discloses still another question and answer board game comprising a plurality of separate playing paths thereon (one for each player). Order of play and movement along the paths is determined by rolls of a die. Movement along each path is recorded by a marker and enabled by correct answers to questions appearing on cards from a plurality of decks selected randomly by a spinner mounted on the board. The game is provided with a plurality of interchangeable faces for the subject category selector acting in conjunction with the spinner, as well as a separate set of question and answer cards for each interchangeable face. A timer is provided to limit the response period to the questions asked.

U.S. Pat. No. 4,988,108 to Shepard shows yet another question and answer board game which is restricted to geography and primarily to the geography of the continental United States, i.e. the states thereof. However, the game is also applicable to the geography of other regions, continents, as well as the entire world itself. The region selected is marked on the board and surrounded by a player travel path. Movement along the path is marked by player tokens and enabled by correct answers to questions appearing on cards randomly selected from a plurality of decks by a rotatable pointer mounted on the board.

As such, it may be appreciated that there continues to be a need for a new and improved question and answer board game which addresses both the problems of ease of use, portability, and effectiveness in construction, and in this respect, the present invention fulfills this need.

SUMMARY OF THE INVENTION

In view of the foregoing disadvantages inherent in the known types of educational board games now present in the prior art, the present invention provides a comprehensive question and answer board game which is directed specifically to pertinent identifying or characteristic data, including a geography, of all fifty states of the United States. The categories of pertinent state data include state capitol, sports, potpourri, industry/-goods, state nickname, and point of interest. The game also includes an improved random category or topic selector. As such, the general purpose of the present invention, which will be described subsequently in greater detail, is to provide a new and improved question and answer board game which has all the advantages of the prior art educational board games and none of the disadvantages.

To attain this, the present invention includes a game board having a substantially oval and endless playing track imprinted on its planar surface. The playing track is divided into thirty six substantially rectangular sectors and fifteen triangular sectors. Each of the rectangular sectors and fourteen of the triangular sectors is labeled with the name of one of the fifty states. The remaining or fifteenth sector is labeled "START". Positioned centrally on the game board and within the playing track is a random data or topic selector which includes a spinner rotatably mounted on the center of the board in a position overlying a data or topic circle imprinted on the board. The topic circle is divided into six equally sized sectors which are each labeled with one of the topics state capitol, sports, potpourri, industry/-goods, state nickname, and point of interest. Each sector is colored differently. A set of five game pieces wherein each game piece is configured in a commonly recognizable shape is provided for each player to mark his position on the playing track. A conventional die is provided to determine order of play and movement of the game pieces on the track. Sets of six board markers each are provided for each player, and each board marker of each set is colored to match each sector of the topic circle. A deck of fifty cards, one for each state, have the question and answers for the six topics identified on the sectors of the topic circle printed thereon. The topic circle may alternatively be constructed as a separate disc mounted in a complementary recess in the center of the board. The disc, which may also have arcuate slots therethrough, is moveable vertically relative to the board to cause the spinner to rotate and randomly select one of the topics on the disc.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved question and answer board game which has all the advantages of the prior art educational board games and none of the disadvantages.

It is another object of the present invention to provide a new and improved question and answer board game which may be easily and efficiently manufactured and marketed.

It is a further object of the present invention to provide a new and improved question and answer board game which is of durable and reliable construction.

An even further object of the present invention is to provide a new and improved question and answer board game which is susceptible of a low cost of manufacture with regard to both materials and labor, and which accordingly is then susceptible of low prices of sale to the consuming public, thereby making such educational board games economically available to the buying public.

Still yet another object of the present invention is to provide a new and improved question and answer board game which provides in the apparatuses and methods of the prior art some of the advantages thereof, while simultaneously overcoming some of the disadvantages normally associated therewith.

Still another object of the present invention is to provide a new and improved question and answer board game which is more comprehensive with respect to the questions posed relating to characteristic data of all fifty states of the United States, i.e. the questions are not limited to geography, thus rendering the game more educational and interesting.

Yet another object of the present invention is to provide a new and improved question and answer board game which has a topic question selector which is not responsive to the turning force applied by a player, thus increasing randomness and fairness of topic selection to thereby heighten interest and excitement in the game.

Even still another object of the present invention is to provide a new and improved question and answer game which is particularly directed to informative characteristic data relating to all fifty states of the United States thereby providing a genuine source of self-improvement and education to participating players, particularly younger players interested in the history of the U.S.A.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a partial perspective view of the game board of the present invention illustrating a second embodiment of the random topic selector in the latched position.

FIG. 9 is a partial perspective view of the game board of the present invention illustrating the second embodiment of the topic selector in the open position.

FIG. 12 is a detailed plan view of the question side of a representative question and answer card of the present invention.

FIG. 13 is a detailed plan view of the answer or reverse side of the representative question and answer card shown in FIG. 12.

DESCRIPTION OF THE PREFERRED EMBODIMENT

Figure 1:
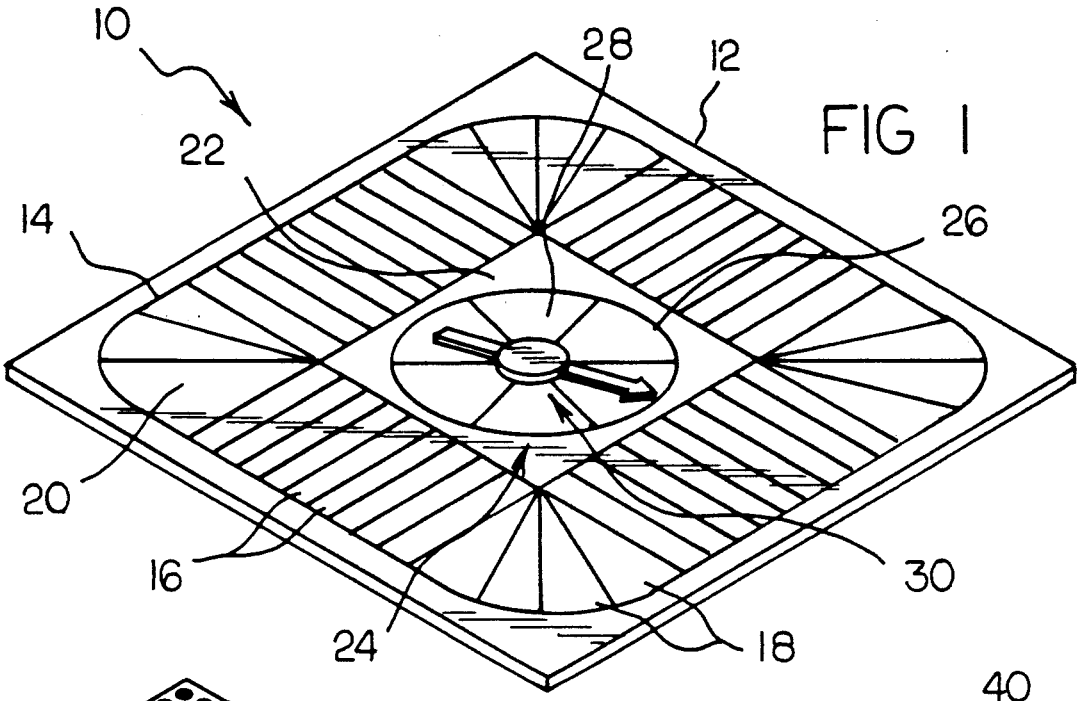
FIG. 1 is a perspective view of the game board of the present invention.

With reference now to the drawings, and in particular to FIGS. 1–13 thereof, a new and improved question and answer board game embodying the principles and concepts of the present invention and generally designated by the reference numeral 10 will be described.

Figure 6:
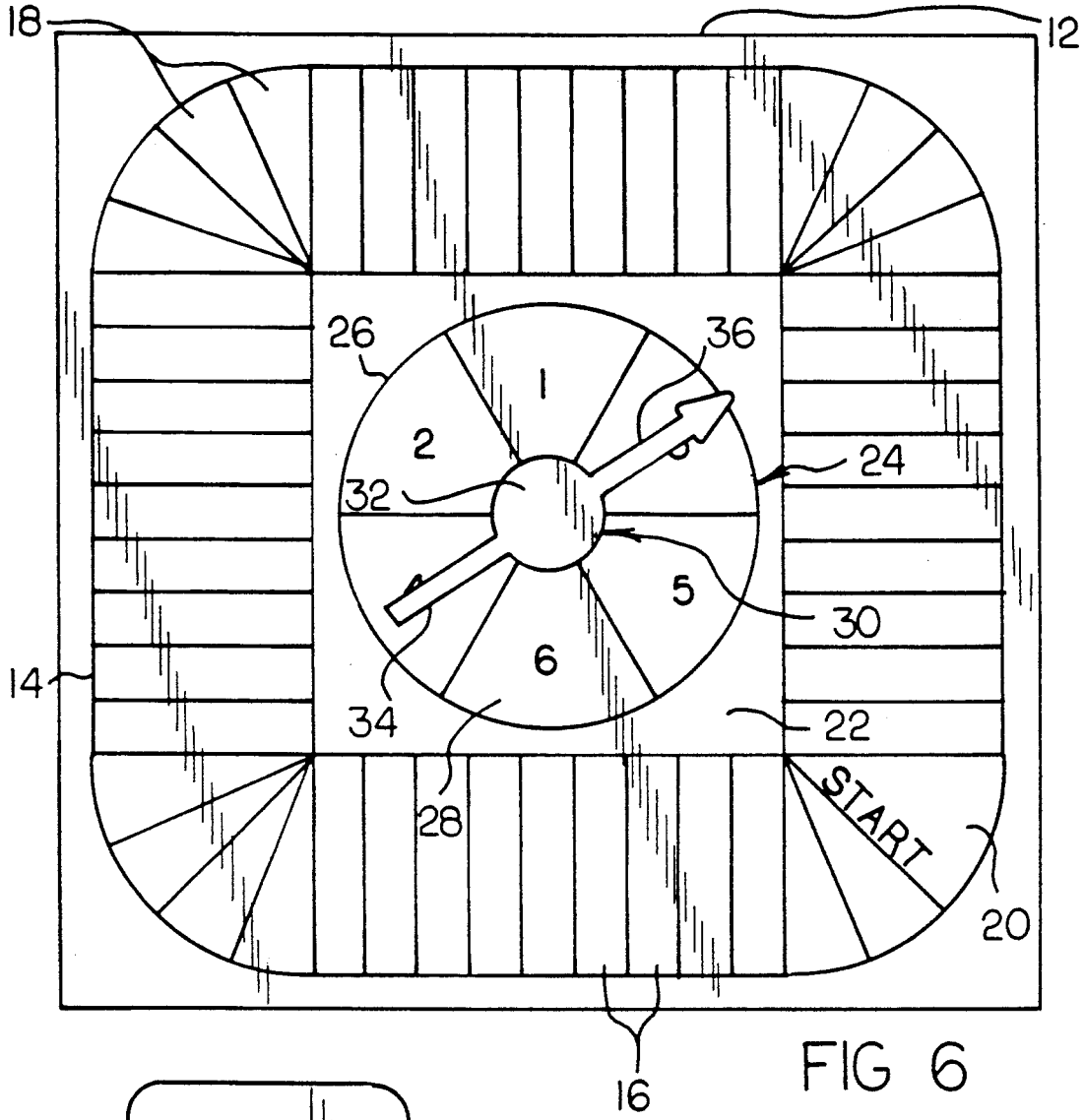
FIG. 6 is a plan view of the game board of the present invention.
Figure 7:
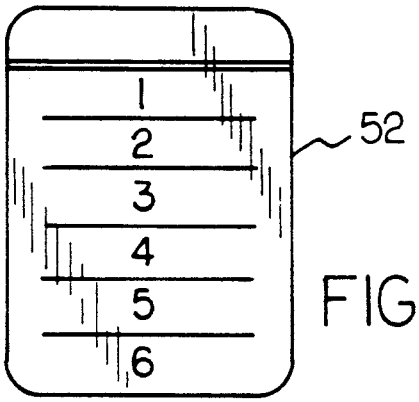
FIG. 7 is a plan view a question and answer card of the present invention.

More specifically, and referring particularly to FIGS. 1 and 6, question and answer board game 10 includes a planar game board 12 which may be constructed of a rigid material such as wood, cardboard, or polymeric material. Imprinted on one planar surface of board 12 is a substantially oval and endless playing track 14 which is divided into thirty-six substantially rectangular sectors 16, fourteen substantially pie-shaped sectors 18, and one substantially pie-shaped "START" sector 20. A substantially square central area 22 is formed within track 14. Each of the sectors 16 and 18 are labeled (not shown) with the name of one of the fifty states of the United States. Mounted in the center of central area 22 is a random topic selector 24. Selector 24 includes a topic circle 26 imprinted on board 12. The center of circle 26 lies at the center of board 12 and area 22. Circle 26 is divided into six equally-sized, substantially pie-shaped sectors 28. Each sector 28 is labeled (not shown) with one of the categories of topic questions, i.e. state capitol, sports, potpourri, industry/goods, state nickname, and point of interest. Further, each sector 28 is colored (not shown) with a different color for each topic. Selector 24 further includes a manually operable spinner 30 which is rotatably mounted on board 12 in a horizontal plane overlying the planar playing surface of board 12 and topic circle 26. Spinner 30 is mounted on the common centers of board 12, area 22, and circle 26. Spinner 30 includes a central hub 32, a tail section 34 joined to and extending radially outwardly from the periphery of hub 32, and a head section 36 having an indicating arrow on its outer end. Section 36 is joined to and extends radially outwardly from the periphery of hub 32 at a position diametrically opposite to that of tail section 34.

Figure 2:
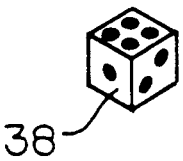
FIG. 2 is a perspective view of the die of the present invention.

FIG. 2 shows the game's random order-of-play and playing track movement determining means, i.e. a conventional die 38 having one through six dots, respectively, on its six sides.

Figure 3:
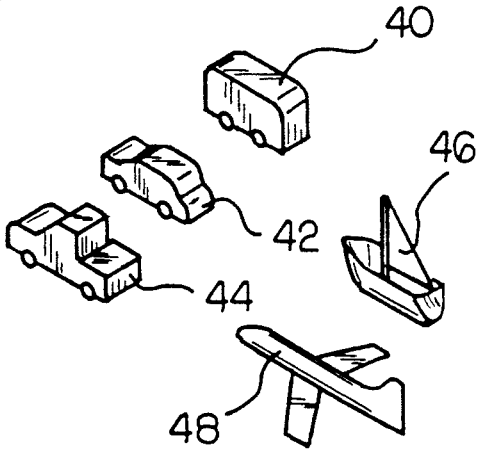
FIG. 3 is a perspective view of the set of game pieces of the present invention.

FIG. 3 depicts the set of game pieces, one piece being provided for each player. Since the game is designed for 2–5 players, the set comprises five pieces. Each piece is configured in a commonly recognizable shape, namely, a bus 40, a car 42, a truck 44, a sailboat 46, and an airplane 48. The shapes shown are merely representative; accordingly, other common forms may be used and are encompassed within the scope of the invention.

Figure 4:
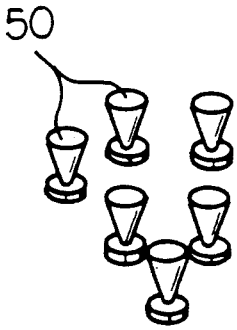
FIG. 4 is a perspective view of a set of board markers of the present invention.
Figure 5:
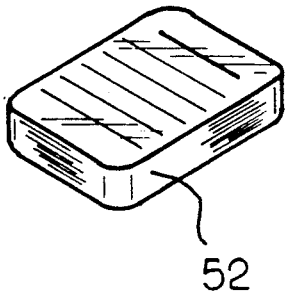
FIG. 5 is a perspective view of the deck of question and answer cards of the present invention.

Turning now to FIG. 4, a set of board markers 50 is illustrated. Each set includes six markers 50 having a common shape, and one set is provided for each player. The sets for other players (not shown) are configured in different shapes. Each marker 50 of each set is colored differently (not shown), and the colors of each marker 50 match the colors of each sector 28 of topic circle 26.

FIGS. 5,7,12, and 13 are illustrative of the set of fifty question and answer cards 52 (one for each state), wherein the six topic questions and answers are imprinted thereon, i.e. the questions relating to state capitol, sports, potpourri, industry/goods, state nickname, and point of interest appear on one side of the cards 52, and the answers to these questions appear on the reverse side thereof.

Figure 10:
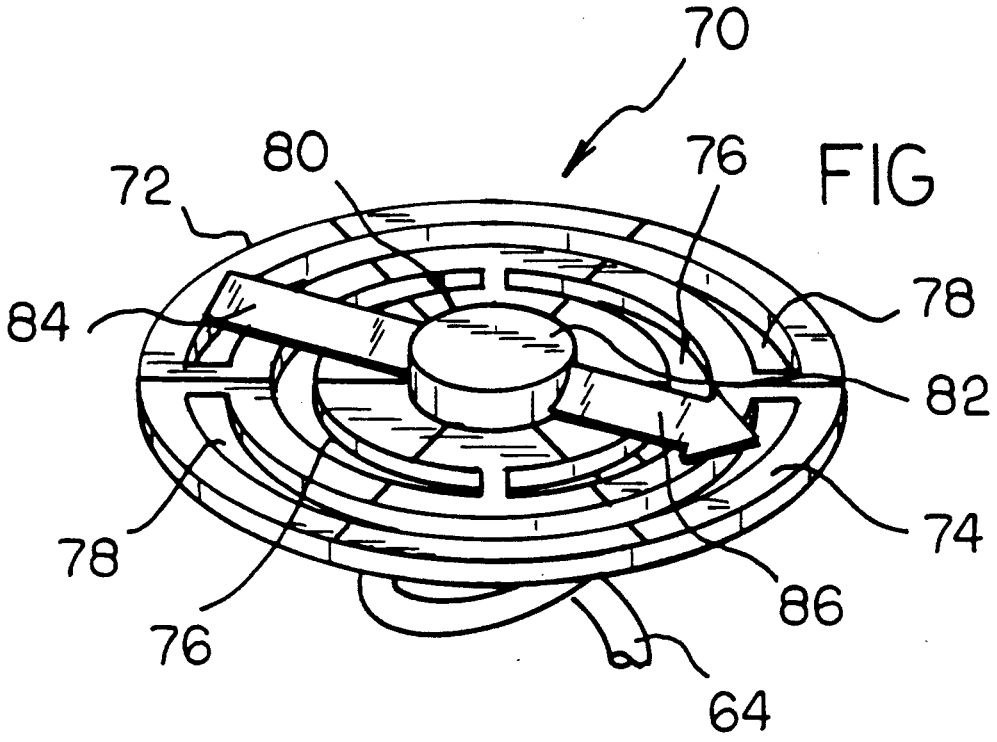
FIG. 10 is a partial perspective view illustrating a third embodiment of the topic selector of the present invention.
Figure 11:
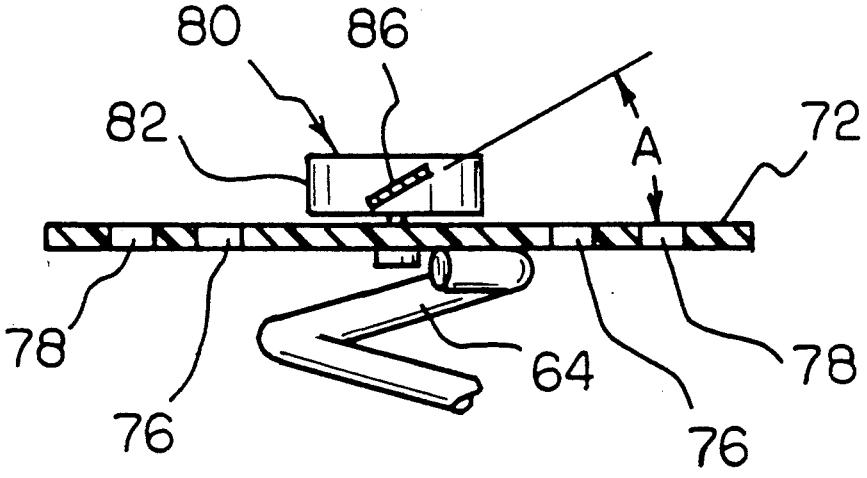
FIG. 11 is an elevational view, partly in cross-section, of the third embodiment of the topic selector as shown in FIG. 10.

To maximize the randomness the selection of topic questions and answers on cards 52, a second embodiment of the random topic selector is provided. As shown in FIGS. 8 and 9, random topic selector 54 comprises a topic disc 56 which is a distinct element from board 12. Disc 56 is divided into six sectors 58 in the same manner as topic circle 26 (with its sectors 28) of the first. Positioned in overlying relationship with disc 56 is a spinner 60 which is rotatably mounted on the center of disc 56 and is structurally identical to spinner 30 of the first embodiment. Disc 56 is dimensioned to fit within a complementary circular recess 62 in board 12. Attached to the underside of disc 56 at the center thereof is one end of a compression spring 64 (FIG. 9). The opposed end of spring 64 is positioned within a circular recess 66 located centrally within recess 62 and board 12. Disc 56 is held in a closed position (FIG. 8), i.e. wherein disc 56 lies in recess 62 and spring 64 is compressed, by a spring-biased latch 68. Manual actuation of latch 68 from its FIG. 8 position in contact with disc 56 to its open position in FIG. 9 separated from contact with disc 56 causes disc 56 to be released from latch 68 which results in the rapid vertical movement of disc 56 and spinner 60 from recess 62 in board 12 due solely to the extension of spring 64. Simultaneously, this upward movement of disc 56 effected by spring 64 in turn causes rotation of spinner 60 and a more random indication of a topic on one of the sectors 58 as opposed to the manual rotation of spinner 30 in the first embodiment. A third embodiment of the random topic selector is shown in FIGS. 10 and 11. Topic selector 70 is intended as an alternative to selector 54 and includes a topic disc 72 having six sectors 74 in the same manner as sectors 28 of circle 26 and sectors 58 of disc 56. However, disc 72 further includes a first set of substantially semi-circular inner air slots 76 extending through sectors 74, as well as a second set of substantially semi-circular outer air slots 78 extending through sectors 74 in a position around slots 76. Spinner 80 is rotatably mounted centrally on disc 72 and has a central hub 82 and a tail section 84 and a head section 86 extending therefrom in the same manner as the head and tail sections of spinners 30 and 60. However, tail 84 and head 86 sections extend from hub 82 in a manner wherein they are inclined at an acute angle A with respect to hub 82 and disc 72 (FIG. 11). Release of disc 72 by latch 68 for topic selection causes rapid vertical movement of disc 72 from recess 62 in board 12 and rotation of spinner 80 in the same manner described with respect to selector 54. However, due to the further provision of air slots 76 and 78 in disc 72, air rushes through those slots during upward movement of disc 72 and impacts on angled tail 84 and head 86 sections to cause increased turning force to act on spinner 80 an thereby add a further factor of randomness to topic selection, i.e. the stopping position of spinner 80 is further varied by the increased application of turning force supplied by air moving through slots 76 and 78 in addition to the elevating force supplied by spring 64.

As previously noted above, board game 10 is designed to be played by 2–5 players. The object of the game is to be the first player to correctly answer questions from each of the six topics, i.e. state capital, sports, potpourri, industry/goods, state nickname, and point of interest. Initially, each player selects one of the game pieces 40,42,44,46,or 48 and a set of six board markers 50 (one of each topic color). All the players then place their selected game piece 40,42,44,46,or 48 in the "START" sector 20 on board 12. Each player then rolls die 38 to determine the order of play. The first player, as determined by the rolls of die 38, rolls die 38 again and moves his game piece along playing track 14 in a clockwise direction from sector 20 for the number of sectors 16, 18 indicated by the corresponding number on die 38, and places his game piece in that sector. The first player then rotates either spinner 30, 60, or 80 on a selected embodiment of game board 12 in the manner previously described to randomly determine the topic question to be answered as indicated on either circle 26, disc 56, or disc 72, respectively. One of the opponent players then pulls out the appropriate card 52 from the deck which matches the state sector 16 or 18 landed on along track 14 by the first player and occupied by his game piece (any of 40,42,44,46 or 48) and asks the question appearing on that card 52 which matches the topic indicated on either circle 26, disc 56, or disc 72. If the first player answers that question correctly, a board marker 50 that matches the color of the topic sector 28,58, or 74 is placed on the state sector 16 or 18 landed on. The process is repeated by the first player until an incorrect answer is given. Then the remaining players participate, in a clockwise direction, using the same procedure as the first player and in the sequence established by the initial roll of die 38. Numerous rounds of play may be required by all of the players to determine a winner. If a player lands on a state sector 16 or 18 that already has a board marker 50 of another player already on it, and he/she correctly answers a question posed to him/her, that player may remove marker 50 of that player and place and place his/her marker 50 on that same state sector 16 or 18 and rotate either spinner 30,60, or 80 one or more times until a incorrect answer is given. If the player answers that question incorrectly, the other player's board marker 50 remains on the state sector 16 or 18 and the next clockwise player takes his/her turn. Finally, if a player spins to a topic on either circle 26, disc 56, or disc 72 that said player has already answered correctly for a particular state, i.e. his/her marker 50 having the same color as a sector 28,58, or 74 is already on the state sector 16 or 18, then that player spins again.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A question and answer board game comprising:

a game board having a planar playing surface, said game board having a central recess therein, wherein said planar playing surface has a playing track imprinted thereon, wherein said playing track is divided into a plurality of first area sectors, wherein each of said first area sectors is labeled with the name of one of the states of the United States;

a random topic question selector which includes a topic question member mounted on said game board, wherein said topic question member is divided into a plurality of second area sectors, and a topic question indicator rotatably connected to said topic question member in overlaying relationship therewith for randomly marking one of said second area sectors and identifying a topic question to be posed to one game player after said indicator has been manually spun by an opponent game player, wherein said topic question member includes a disc and a circle imprinted on a planar surface of said disc, means for releasably securing said disc in a closed position in said central recess, and means connected to said disc and said central recess for removing said topic question selector from said central recess and vertically elevating said topic question selector relative to said planar playing surface causing spinning of said rotatable topic question indicator and random identification of said topic question on said circle upon manual release of said disc securing means;

a plurality of game pieces, wherein each of said game pieces is configured in a different shape and sized to be positioned on said first area sectors of said playing track, and wherein one of said game pieces is provided for each game player;

a plurality of sets of board markers, wherein each set of said board markers includes a plurality of said board markers, wherein said board markers of each set are commonly shaped and each set of said board markers is configured in a different shape, wherein the shapes of said game pieces are different from each other, and wherein one set of said board markers is provided for each game player;

a set of cards, one card for each of said states, each of said cards having topic questions and answers printed thereon for each of said topic question identified by each of said second area sectors; and means for randomly determining an order-of-play sequence for said game players and for determining and marking movement of each of said game player's game piece along said playing track.

2. The question and answer board game as set forth in claim 1, wherein said playing track is a substantially oval and continuous loop, wherein said first area sectors include a plurality of substantially rectangular sectors and a plurality of substantially triangular sectors, and wherein said playing track further includes a third, substantially triangular sector for receiving all of said game pieces of said game players at a starting point of a game.

3. The question and answer board game as set forth in claim 1, wherein said plurality of second area sectors include a set of six equally-sized second areas sectors, wherein each of said six second area sectors is colored with a different color and is labeled with one of the topic questions which include state capitol, sports, potpourri, industry/goods, state nickname, and point of interest.

4. The question and answer board game as set forth in claim 3, wherein each of said board markers of each of said sets is colored with a color matching said color of each of said second area sectors.

5. The question and answer board game as set forth in claim 1, wherein said means for releasably securing said disc in said central recess comprises a manually pivotable latch for engaging a peripheral portion of said disc; and wherein said means for removing said topic question selector from said central recess and elevating it relative to said planar surface comprises a compression spring, wherein one end of said compression spring is attached to an underside of said disc, and an opposed end is secured in said central recess.

6. The question and answer board game as set forth in claim 1, wherein said rotatable topic question indicator comprises a spinner having a central hub with an outer periphery, connecting means rotatably joining said hub to said disc at their respective centers, a tail section extending radially outwardly from a portion of said hub outer periphery, and a head section joined to and extending radially outwardly from a diametrically opposite portion of said hub outer periphery in alignment with said tail section, said head section having an outwardly directed arrow head formed on an outer end thereof, and wherein said head and tail sections are angled relative to said hub periphery and said disc.

7. The question and answer board game as set forth in claim 1, wherein said means for randomly determining an order-of-play sequence for said game players and for determining and marking movement of each of said game player's game piece along said playing track is a die.

8. The question and answer board game as set forth in claim 1, wherein said disc further includes a plurality of air slots extending therethrough.

9. The question and answer board game as set forth in claim 8, wherein said plurality of air slots include a first pair of inner, substantially semi-circular air slots extending through said disc and lying in spaced relationship with each other on a first circumference, and a second pair of outer, substantially semi-circular air slots extending through said disc and lying in spaced relationship with each other on a second circumference, wherein each slot of said second pair of outer air slots is positioned in surrounding relationship with and parallel to a respective one of said first pair of inner air slots.

* * * * *